US009079746B2

(12) United States Patent
Omli

(10) Patent No.: US 9,079,746 B2
(45) Date of Patent: Jul. 14, 2015

(54) POOL LANE LINE REEL APPARATUSES, SYSTEMS, AND METHODS

(76) Inventor: Kristen Omli, Winston-Salem, NC (US)

( * ) Notice: Subject to any disclaimer, the term of this patent is extended or adjusted under 35 U.S.C. 154(b) by 1350 days.

(21) Appl. No.: 12/272,165

(22) Filed: Nov. 17, 2008

(65) Prior Publication Data

US 2009/0127368 A1 May 21, 2009

Related U.S. Application Data

(60) Provisional application No. 60/988,463, filed on Nov. 16, 2007.

(51) Int. Cl.
*B65H 27/00* (2006.01)
*B65H 75/44* (2006.01)
*E04H 4/14* (2006.01)

(52) U.S. Cl.
CPC ..... *B65H 75/4407* (2013.01); *B65H 75/4492* (2013.01); *E04H 4/143* (2013.01)

(58) Field of Classification Search
USPC ..... 242/395, 403, 403.1, 557, 397.2–397.4; 4/496, 505
See application file for complete search history.

(56) References Cited

U.S. PATENT DOCUMENTS

| | | | | |
|---|---|---|---|---|
| 318,787 | A | 5/1885 | Parker | |
| 3,531,059 | A * | 9/1970 | Walker | 242/397.3 |
| 3,698,656 | A | 10/1972 | Ballenger | |
| 3,755,829 | A | 9/1973 | Walklet | |
| 3,845,510 | A | 11/1974 | Baker et al. | |
| 3,876,045 | A * | 4/1975 | Knarreborg | 191/12.2 R |
| 4,012,002 | A | 3/1977 | McDonald et al. | |
| 4,122,560 | A * | 10/1978 | Baker | 4/505 |
| 4,174,809 | A * | 11/1979 | Arlemark | 239/745 |
| 4,228,553 | A * | 10/1980 | Genuit | 4/490 |
| 4,487,380 | A | 12/1984 | King | |
| 4,540,017 | A | 9/1985 | Prange | |
| 4,655,399 | A * | 4/1987 | Harvey | 239/745 |
| 4,993,449 | A | 2/1991 | Stutzman et al. | |
| 5,119,843 | A * | 6/1992 | Keenan | 137/355.23 |
| 5,183,218 | A * | 2/1993 | Gavagna | 242/388 |
| 5,240,228 | A | 8/1993 | Silveri | |
| 5,425,143 | A | 6/1995 | Kalandovsky | |
| 5,495,995 | A | 3/1996 | Dominique et al. | |
| 5,520,562 | A | 5/1996 | Eddy | |
| 5,722,613 | A | 3/1998 | Michael | |

(Continued)

FOREIGN PATENT DOCUMENTS

| | | | |
|---|---|---|---|
| KR | 20-1999-0002014 | U | 1/1999 |
| KR | 10-2001-0076628 | A | 8/2001 |
| KR | 10-2004-0046574 | A | 6/2004 |

OTHER PUBLICATIONS

Swim Outlet—Storage Reels, web page at http://www.swimoutlet.com/product_p/1906.htm, as available via the Internet and printed on Apr. 19, 2007.

(Continued)

*Primary Examiner* — Sang Kim
(74) *Attorney, Agent, or Firm* — Kilpatrick Townsend & Stockton LLP

(57) ABSTRACT

An apparatus, kits, and methods for reeling a pool lane line are described herein. Some embodiments of the apparatus can include a lane line guide configured to guide the positioning of a pool lane line along an axis of the apparatus. Some embodiments of the apparatus can include a manipulandum in communication with an axle of the apparatus.

11 Claims, 14 Drawing Sheets

(56) References Cited

U.S. PATENT DOCUMENTS

| | | | | |
|---|---|---|---|---|
| 6,050,290 | A * | 4/2000 | Yacobi et al. | 137/355.2 |
| 6,055,682 | A * | 5/2000 | Sanchez | 4/496 |
| 6,178,992 | B1 | 1/2001 | Van Der Paal | |
| 6,382,241 | B1 * | 5/2002 | Setrum | 137/355.22 |
| 6,618,869 | B1 | 9/2003 | Jacobs | |
| 6,622,318 | B2 | 9/2003 | Mathis | |
| 6,742,740 | B2 | 6/2004 | Tisbo et al. | |
| 6,811,110 | B2 | 11/2004 | Tsao | |
| 6,871,362 | B1 | 3/2005 | Zell | |
| 6,908,058 | B2 | 6/2005 | Moon et al. | |
| 6,974,103 | B1 | 12/2005 | Pansini | |
| 6,976,649 | B2 | 12/2005 | Tisbo et al. | |
| 7,370,823 | B2 * | 5/2008 | Lammermann et al. | 242/397.2 |
| 2001/0023506 | A1 | 9/2001 | Mathis et al. | |
| 2004/0021030 | A1 | 2/2004 | Brocking | |
| 2006/0054731 | A1 * | 3/2006 | Nagler | 242/397.3 |
| 2006/0144986 | A1 * | 7/2006 | Tsai | 242/397.2 |

OTHER PUBLICATIONS

Brock Enterprises—Racing Lane Line Storage Reels, web page at http://www.brockent.com/CategoryView.asp?CategoryId=403 as available via the Internet and printed on Apr. 19, 2007.

In the Swim—Sheridan Lane Line Storage Reel, web page at http://www.intheswim.com/Commercial-Products/Competitive-Swimming-and-Training-A as available via the Internet and printed on Apr. 19, 2007.

Lincoln Commercial Pool Equipment—Lane Line Storage Reels and Accessories, web page at http://www.lincolnaquatics.com/shop/catalog/Lane+Line+Storage+Reels+and+Accessories as available via the Internet and printed on Apr. 19, 2007.

Brookforge—Competition Equipment, web page at http://www.brookforge.co.uk/product-cm-lane_line_storage.htm as available via the Internet and printed on May 3, 2007.

Recreonics—Swimming Pool Racing Lanes Storage Reels, web page at http://www.recreonics.com/racing_lanes_storage.htm as available via the Internet and printed on Apr. 24, 2007.

Kiefer Pool Equipment—Kiefer Wave Eater, web page at http://www.kieferpool.com/wave_eater_eater.htm as available via the Internet and printed on Aug. 8, 2007.

AntiWave Pool Products—AntiWave "Ultimate" Lane Storage Reels, web page at http://www.antiwave.com/storagereels.htm, as available via the Internet and printed on Sep. 28, 2007.

Lincoln Aquatics—Ultimate Maxi-size Storeel, web page at http://www.lincolnaquatics.com/PrintablePage.asp, as available via the Internet and printed on Sep. 28, 2007.

Recreonics—Racing Lane Storage, web page at http://www.recreonics.com/racing_lanes_storage.htm, as available via the Internet and printed on Sep. 26, 2007.

Latest Gadget Japan, JUN 23—Automatic Hose Storage Reel: Reel Smart, web page at http://www.seihin-world.com/s/2006/06/23_0338.php, as available via the Internet and printed on Nov. 11, 2008.

Amazon.com: Reel Smart 60-Foot Hose Reel, Gray #RS-06051: Home Improvement, web page at http://www.amazon.com/ReelSmart-60-Foot-Hose-Reel-RS-06051/dp/B0001GMGM8, as available via the Internet and printed on Nov. 11, 2008.

MyReels.Com—Hose Reel, Garden Hose Reels, Suncast and Air Hose Reels, web page at http://www.myreels.com/default.asp, as available via the Internet and printed on Nov. 11, 2008.

International Search Report mailed Apr. 20, 2009 for corresponding PCT/US2008/083747.

Written Opinion mailed Apr. 20, 2009 for corresponding PCT/US2008/083747.

* cited by examiner

POOL LANE LINE REEL APPARATUSES, SYSTEMS, AND METHODS

CROSS REFERENCE TO RELATED APPLICATIONS

The present application claims priority under 35 USC 119 (e) from U.S. Provisional Patent Application No. 60/988,463, filed Nov. 16, 2007, which is incorporated by reference herein in its entirety.

FIELD OF INVENTION

The present invention relates to apparatuses, systems, and methods for reeling and storing swimming pool lane lines.

BACKGROUND

In swimming pools, lane lines are often utilized to provide boundaries at the water's surface between the number of lanes within the pool. When a pool is divided into lanes, it can be used for competitive swimming or an exercise activity for swimming laps. Many pools, however, are also used for other purposes where it may be desirable to remove the lane lines from the pool. For example, when pools are used for recreational or enjoyment purposes, it is often desirable to not have the lane lines within the pool. Additionally, pool lane lines are often removed daily or with some other frequency from the pool to protect the lines from overexposure to the chemicals in the pool. Exposure to chemicals within a pool can break down the materials that make up the pool lane lines and ultimately result in having to replace the pool lane lines. It may also be desirable to remove pool lane lines to facilitate cleaning the pool. Removal of pool lane lines, however, is not a quick and easy process. Thus, there is a need for improved apparatuses, systems, and methods for reeling and storing swimming pool lane lines.

SUMMARY

Various embodiments of the present invention relate generally to apparatuses, systems, or methods of using an apparatus for reeling and storing swimming pool lane lines.

In some embodiments, an apparatus can comprise a frame, an axle, a manipulandum, and a lane line guide. The axle can be rotatably coupled to the frame. In some embodiments, the axle can be configured to receive a pool lane line therearound, and the manipulandum can be in communication with the axle such that upon manipulating the manipulandum, the axle can be rotated. In some embodiments, the lane line guide can be movably coupled to the frame. The lane line guide can, for example, define a path which is configured to allow passage of the pool lane line and thereby guide the position of the pool lane line along an axis of the axle.

In some embodiments, a pool lane line reeling apparatus can comprise a frame, an axle, and a manipulandum. The axle can be rotatably coupled to the frame. The manipulandum can be rotatably coupled to the frame and in communication with the axle. In some embodiments, the axle can be configured to rotate by less than one full rotation upon the rotation of the manipulandum by one full rotation.

In some embodiments, a kit can comprise an elongated line guide member, a lane line guide, and a bracket configured to mount the elongated line guide member to a pool lane line reeling apparatus. The lane line guide member can be configured to be moved along the elongated line guide member.

These embodiments are mentioned not to limit or define the invention described herein, but to provide examples of embodiments of the invention to aid understanding thereof. Additional uses, advantages, and features of pool lane line reeling apparatuses, systems, and/or methods of using an apparatus are set forth in the illustrative embodiments discussed in the detailed description herein and will become more apparent to those skilled in the art upon examination of the following.

DETAILED DESCRIPTION

Figure 1:
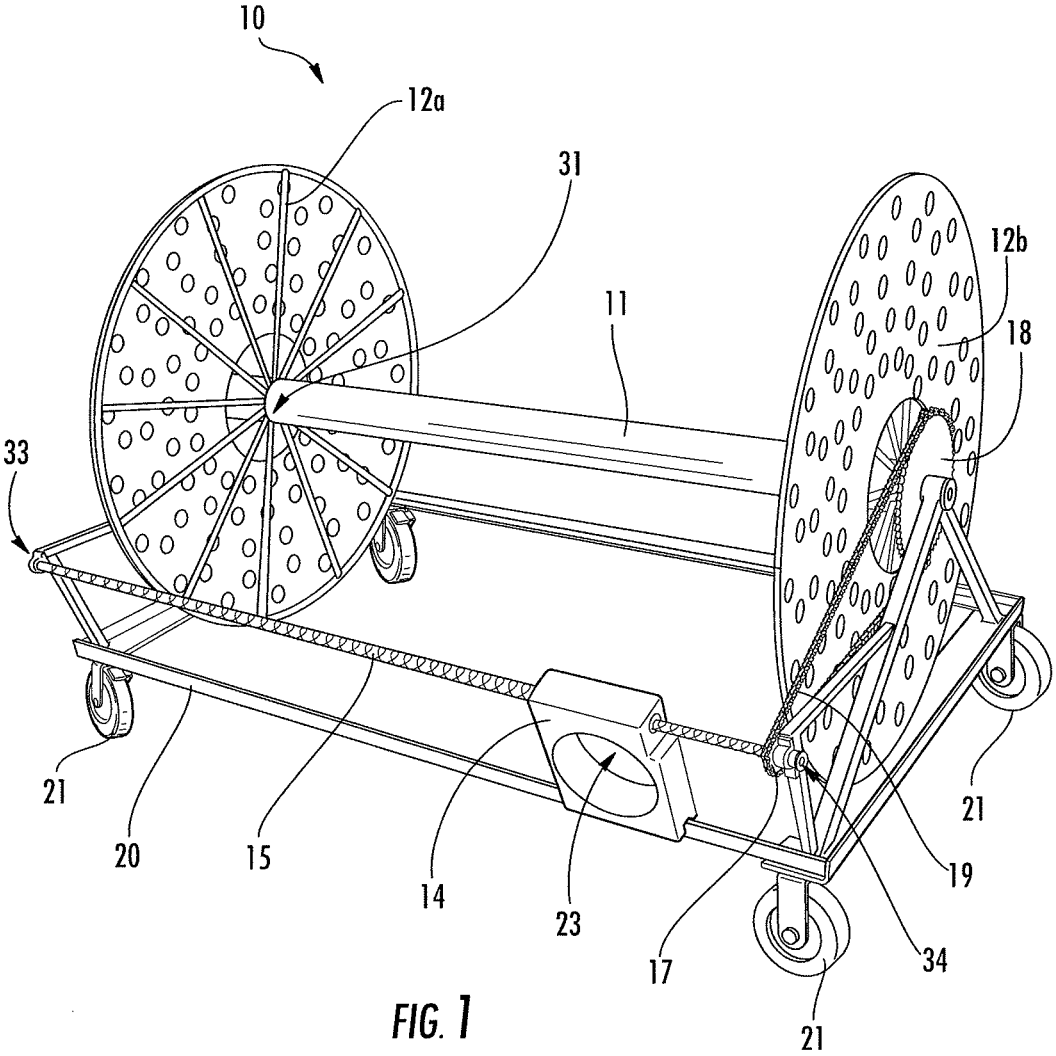
FIG. 1 is a front, top, right side perspective view of an embodiment showing an apparatus for reeling pool lane lines.

The description herein relates to apparatuses, systems, and methods for reeling pool lane lines out of and into swimming pools. Some embodiments described herein can provide a more efficient, easier, safer, or longer-lasting means to reel in, unwind, move, or store pool lane lines.

To remove lane lines from a pool, the lines are often reeled onto a large reel. Reels can consist of two discs connected by an axle that can be rotated to reel the lines out of the pool.

Often at least two people, and up to four people, are required to effectively reel the pool lane lines when using a reeling device.

The discs of some pool lane line reels are often made of fiberglass, stainless steel, or aluminum. A significant amount of rotational force must often be applied to the discs to use the device. A reel must withstand numerous winding and unwinding cycles of the pool lane lines, sometimes as frequently as two times a day for a total of four daily operations of the reel. A typical pool contains two to twelve pool lanes which can be 25 or 50 meters in length, or 25 or 50 yards in length. As the lanes are reeled in, a considerable amount of mass accumulates on the reel device as the entire lanes are wound. Additionally, a reel is often used to hold more than one lane line. Some reels can hold up to 300 meters of lane lines, depending on the diameter of the lane lines.

Not only does this increased weight apply stress to a reel and its discs, the user who manually rotates the disc must exert a significant amount of force upon the discs in order to effectively reel in the lane lines. Due to the increased forces, at least a portion of a disc can separate from the axle connected thereto due to the stresses applied to the device. Also due to the amount of force and stress applied to the reel system, breaks or damage may occur to a disc itself, the support frame or base, the attachment point of the casters and the support frame or base, and/or the casters. This increased force and resulting damage may cause a reel to become inoperable or unsafe, which may ultimately require the user to purchase a new reel device.

To effectively reel the lines onto the reel, often at least three people are needed: one person positioned on each side of the reel rotating a disc, and the third guiding the positioning of the lane line on the axle. The third person guides the lines as they are reeled up to distribute the line along the width of the axle. If the line is not distributed evenly along the width of the axle, additional stress due to the unbalanced weight can be applied to certain parts of the reel device thus causing higher chances of failure or injury. Further, undistributed weight may add difficultly in transporting a conventional reel device where the operation of the wheels of the reel are hindered.

Further, a user can be exposed to a risk of injury when operating a lane line reel device. The significant weight of the reel disc and the lane lines can require a significant amount of force to rotate the large discs of a reel, which ultimately can cause muscle strain of the user. A danger of slipping may exist when exerting a large amount of force to rotate the disc on a wet pool deck. Also, as a lane line being reeled in is guided manually along the width of the axle, a greater risk of injury may exist for pinched fingers or hands. Additionally, users of lane line reel devices are often children or young adults who can be more prone to the risk of injury. Thus, some embodiments described herein can address and reduce such risks.

Overview of Various Embodiments

In some embodiments, a pool lane line reeling apparatus can be configured to store multiple lane lines. In other embodiments, a pool lane line reeling apparatus can be configured to store a single pool lane line. For example, in some embodiments, a pool lane line reeling apparatus can be configured to store between two and twelve lane lines at one time. In one such embodiment, the pool lane line reeling apparatus can store as many as five lane lines at one time. In another embodiment, the pool lane line reeling apparatus can be configured to store as many as three lines at one time. One or more of the diameter of an included containing member, the length or diameter of an axle, the size or configuration of a manipulandum, or the size of a motor used with a pool lane line reeling apparatus can vary depending upon the desired number of lane lines to be stored and the cross-sectional diameter of the lane lines to be stored.

In some embodiments, a pool lane line reeling apparatus can comprise a frame. The frame can be made from fiberglass, plastic, stainless steel, aluminum, or another suitable material or combination of materials. The frame can comprise a plurality of support members assembled to provide a structure to which one or more components of the apparatus may attach. The frame can provide a stable structure during use of the apparatus and/or transport of the apparatus. In some embodiments, the frame comprises a plurality of support members that may be joined and affixed together using techniques such as welding, brazing, casting, molding, fastening, and other techniques known to those skilled in the art.

In some embodiments, a frame may comprise a plurality of support members extending in substantially vertical direction. In some embodiments, the frame can comprise a panel positioned above the axle, for example forming a roof-like structure. The roof may protect the apparatus from exposure to weather. In some embodiments, the roof can provide a surface to support one or more other objects. For example, in an embodiment, one or more solar panels may be affixed to a roof structure in order to collect and store energy in a battery. As another example, the roof structure can provide a surface to display advertising information, marketing information, sponsorship information, and/or other decorative graphics or materials In some embodiments, a pool lane line reeling apparatus can comprise an axle. The axle can be configured to receive a pool lane line. For example, upon rotation of an axle, pool lane lines can be reeled out of the pool and stored around the axle. The apparatus can then be moved and stored with the pool lane lines in a reeled position. In some embodiments, the axle can be rotatably coupled to the frame.

In some embodiments, the axle can be fabricated from, for example, fiberglass, plastic, stainless steel, aluminum, or another suitable material or combination of materials. In some embodiments, the axle can be substantially cylindrical having a circular cross sectional diameter of sufficient size and thickness to facilitate reeling and storing of one or more lane lines. In some embodiments, the axle can comprise a diameter between about 3 inches to about 6 inches. For example, in one embodiment, the axle can comprise a diameter of about 4.5 inches. In some embodiments, the axle can comprise a length of between about 55 inches to about 80 inches. For example, in one embodiment, the axle can comprise a length of about 62.5 inches as measured from an inside surface of one containing member to an inside surface of a second containing member. For example, in one embodiment, the axle can comprise a length of about 72 inches from an outside surface of one containing member to an outside surface of a second containing member. In other embodiments, one or both of the diameter or length of an axle can comprise a larger or smaller dimension.

In some embodiments, the pool lane line reeling apparatus can comprise a manipulandum. A manipulandum comprises to a physical object or device that can be moved or displaced in space. The manipulandum can be in communication with the axle. For example, the axle can be configured to be rotated when the manipulandum is manipulated. In some embodiments, the apparatus can comprise more than one manipulandum in communication with the axle. In some embodiments, the manipulandum can be a wheel or a captain's wheel. In other embodiments, the manipulandum can be a crank.

In yet other embodiments, the manipulandum can be a slider mechanism configured to be moved in a lateral direction, and in communication with a rotational pinion gear in order to convert a linear force into a rotational force, for example similar to a rack and pinion. The pinion can be in communication with the axle such that upon lateral motion of slider and attached rack, the axle can rotate.

In some embodiments where the manipulandum comprises a rotating manipulandum, such as a wheel or captain's wheel, the rotating manipulandum can be attached to a containing member or directly to an axle. In other embodiments, the rotating manipulandum can be attached to the frame. In some embodiments, the rotating manipulandum can be attached along the same axis as the axle. In other embodiments, the rotating manipulandum can be attached offset from the axis of the axle. For example, one or more gears may be in rotational communication with a rotating manipulandum and an axle to facilitate easier reeling in of a lane line. Upon rotation of the rotating manipulandum, the axle can rotate in direct or indirect relation thereto.

In some embodiments where the manipulandum comprises a crank, the crank can be attached to a containing member or an axle. In other embodiments, the crank can be attached to the frame. In some embodiments, the hub of the crank can be attached along the same axis as the axle. In other embodiments, the hub of the crank can be attached offset from the axis of the axle. For example, one or more gears may be in rotational communication with both the hub of a crank and an axle to facilitate easier reeling in of a lane line. Upon rotation of the crank, the axle can rotate in direct or indirect relation thereto.

In some embodiments, a manipulandum can be positioned permanently upon a reeling apparatus. In other embodiments, a manipulandum can be removably attached to a portion of a reeling apparatus, for example a support member using a lock pin mechanism to removably attach the manipulandum.

The manipulandum can be made from fiberglass, plastic, stainless steel, aluminum, or another suitable material or combination of materials. In some embodiments, a manipulandum can reduce the amount of stress applied to specific components of the reel apparatus and thus preserve the life of the reel apparatus. For example, in an embodiment comprising a manipulandum and a containing member, less stress will be applied to the included containing member and thus preserve the structural integrity of the containing member for a longer period of use.

In some embodiments, the manipulandum can provide a mechanical advantage in reeling pool lane lines. For example, in one such embodiment, a drive belt or gear train may be used to provide a mechanical advantage to the user of the apparatus. For example, in one such embodiment, for each full rotation of a rotating manipulandum, an axle in communication therewith may rotate less than one full rotation.

In some embodiments, the apparatus can comprise an electric motor configured to provide assistance with reeling or unwinding a pool lane line off of a reeling apparatus. In one such embodiment, an output shaft of a motor may comprise a gear or pulley coupled thereto, and may be positioned to provide torque (directly or indirectly) to a gear or pulley shaped manipulandum in direct or indirect communication with the axle. Upon provision of torque (directly or indirectly) by a motor used to manipulate the manipulandum, an axle in communication with the manipulandum can thereby be rotated.

In some embodiments, a motor can be operably connected to the manipulandum to facilitate power-assisted reeling of the lane lines. In some embodiments, the motor can be configured to operate in both a forward and reverse direction such that the apparatus may be used to electrically reel the lane lines into a reeled position or aid in the unwinding of the lane lines for use in the pool.

In some embodiments, a motor can comprise a battery-operated DC motor, for example using a rechargeable NiMH or lithium ion battery. In one such embodiment, the battery pack can be attached to the apparatus. In some embodiments, the battery pack can be coupled to a solar panel attached to the device and used as an energy source for recharging the battery. In other embodiments, the motor can comprise an AC motor. In one such embodiment, the AC motor can be plugged into an electrical power outlet using a power cord.

In some embodiments, a pool lane line reeling apparatus comprising a motor can additionally comprise a second manipulandum configured to be manually manipulated. In the event the motor was inoperable, a manual means of reeling the pool lane lines using the second manipulandum can thus be provided. In some such embodiments, the second manipulandum may be removably attached to the apparatus.

In some embodiments, at least one gear or pulley in communication with at least one of a manipulandum or an axle can be rotationally connected to an elongated line guide member, as described in further detail below. In some such embodiments, upon manipulation of the manipulandum, the elongated line guide member can rotate, providing a force configured to move a line lane guide.

Figure 8:
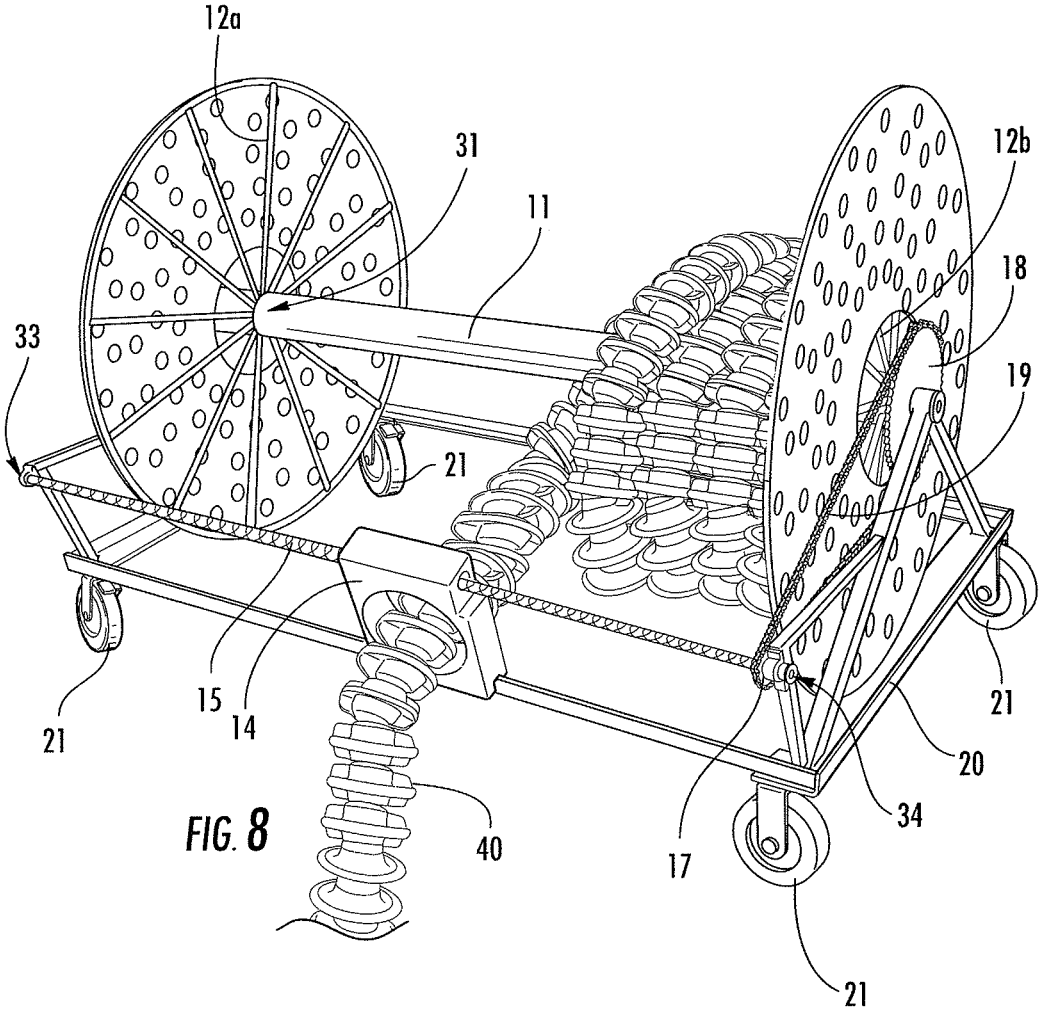
FIG. 8 is a front, top, right side perspective view of an embodiment showing the apparatus of FIGS. 1-3 having a pool lane line in a partially-reeled position.

In some embodiments, a pool lane line reel apparatus can comprise a lane line guide. In some embodiments, the lane line guide can be movably coupled to the frame. For example, a lane line guide can be configured to slide along the axis of an axle. The lane line guide defines a path configured to allow passage of the pool lane line. The path can guide the position of a pool lane line being reeled or unreeled along an axis of the axle. In some embodiments, the path can comprise an opening. In some such embodiments, the opening can comprise complimentary dimensions to a pool lane line such that the pool lane line can pass through the opening without interference. For example, the diameter or width of an opening in a line guide member can be greater than the cross-sectional diameter of a substantially cylindrical pool lane line used therewith. FIG. 8 shows an exemplary embodiment where the pool lane line 40 is extended through lane line guide 14. In other embodiments, the path may comprise a U-shaped path (e.g. in FIGS. 12 and 13). In yet other embodiments, the path may comprise an inverted U-shaped path, or another suitable configuration.

The lane line guide can be fabricated from a material that provide sufficient strength and structural integrity to withstand the forces during passage of the pool lane line through the opening. In some embodiments, the lane line guide can be fabricated from plastic, rubber, fiberglass, metal, or another suitable material or a combination of materials.

In some embodiments, a lane line guide can be movably positioned about an elongated line guide member. In some embodiments, an elongated line guide member can comprise a threaded shaft. Upon rotation of such an elongated line guide member, a lane line guide configured to receive the threads of the elongated line guide member can traverse along the length of the elongated line guide member. For example, in one such embodiment, upon the manipulation of a manipulandum, the elongated lane guide member comprising a threaded shaft rotates. A lane line guide configured to receive the threads of the threaded elongated lane guide member, can thus be driven along a plane substantially parallel to the rotating threaded elongated line guide member. In other embodiments, a manual force can be applied to the lane line guide to move the lane line guide with respect to the elongated line guide member.

The elongated line guide member can be fabricated from a material that provides sufficient strength to withstand the forces during operation of the apparatus. In some embodiments, the elongated line guide member can be fabricated from fiberglass, plastic, stainless steel, aluminum, or another suitable material or a combination of materials.

In some embodiments, the elongated line guide member can be in communication with the manipulandum. In some embodiments, the elongated line guide member is configured to move the lane line guide when the manipulandum is manipulated.

In some embodiments, one or more elongated lane guide members can comprise a worm gear, a screw-like structure, or an auger-like structure. In some such embodiments, upon rotation of a screw-like or auger-like elongated lane guide member, the lane line guide can be configured to move back and forth along the elongated lane guide member such that the pool lane line can be distributed along the entire length of the axle as it is reeled. As such, a lane line guide can serve to reduce the number of users needed to wind or unwind a lane line, reduce the amount of time needed to reel or unreel a lane line, reduce chances for injuries such as pinched fingers to a user, and help to reduce labor costs associated with the tasks of reeling or unreeling lane lines. In some embodiments, at least a portion of a lane line guide and elongated line guide member can comprise a protective cover to minimize exposure to sharp edges or pinching hazards.

In some embodiments, an apparatus can comprise a containing member. The containing member can be positioned with relation to the axle to define a boundary for the pool lane line along the axle. In one such embodiment, the axis of the axle can be substantially perpendicular to a structure of a containing member. In some embodiments, the containing member can be configured to rotate with the axle. In some such embodiments, the containing member can rotate about a central axis shared with the axle. In other embodiments, the containing member can be stationary relative to the rotation of the axle. For example, in some such embodiments, one or more containing members can be part of a frame or attached thereto, either removably or permanently. Upon reeling of the pool lane line, the containing member can provide a physical obstruction such that the pool lane line is guided to the proper position along the axle.

In some embodiments, the apparatus can comprise a plurality of containing members. Each containing member can define at least one boundary. In some embodiments, the pool lane line can be reeled around a section of the axle between multiple boundaries defined by two or more containing members. For example, in an illustrative embodiment, the apparatus can comprise a first containing member and a second containing member. The first containing member can define a first boundary and the second containing member can define a second boundary. In some embodiments, the first containing member can be positioned in proximity to a first end of the axle. The second containing member can be positioned in proximity to a second end of the same axle.

Figure 9:
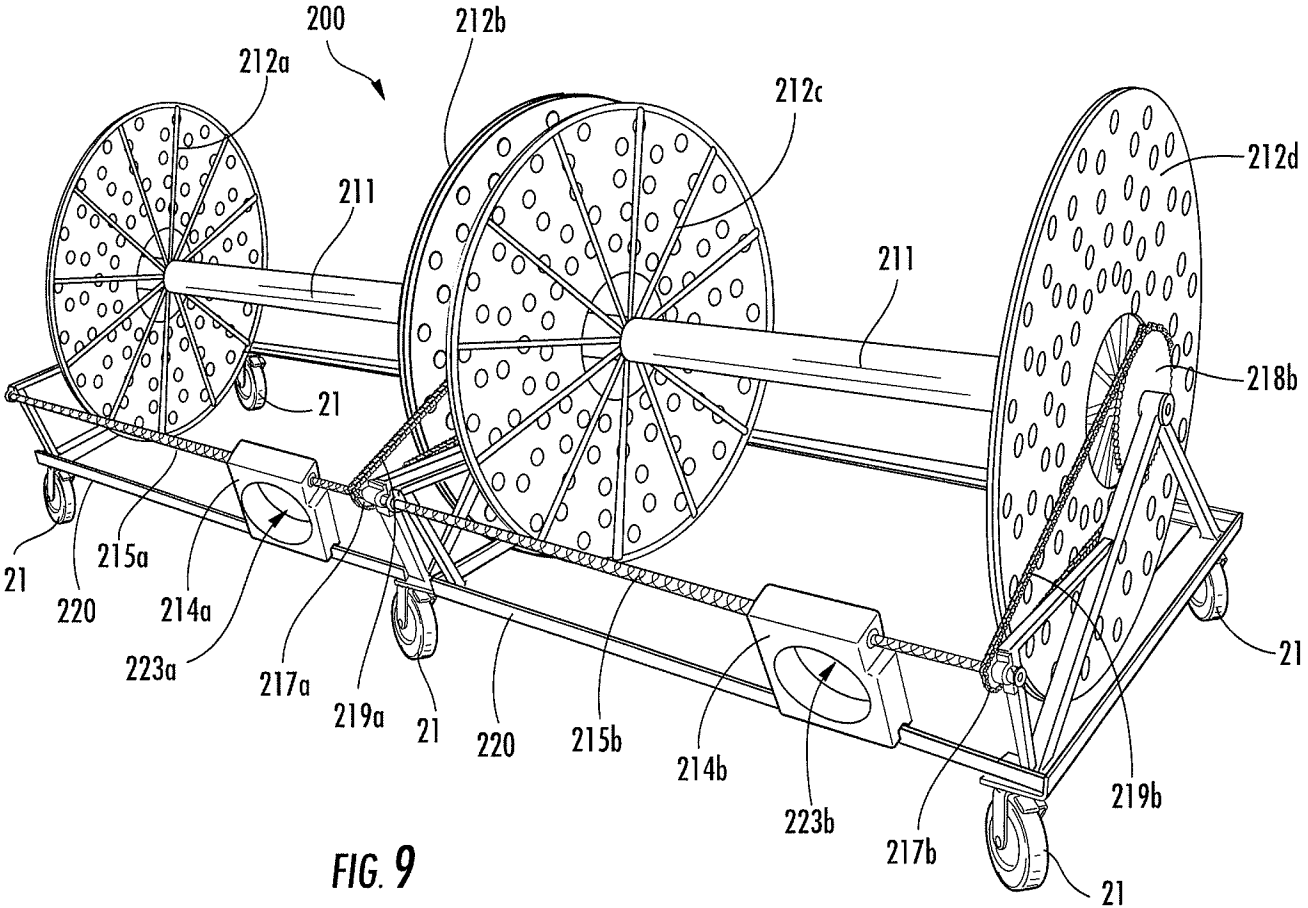
FIG. 9 is a top, right side perspective view of an embodiment showing an apparatus for reeling pool lane lines comprising multiple sections.

In some embodiments, the apparatus can comprise more than two containing members, for example, three, four, or more containing members. In some embodiments, the number of containing members can correlate to the number of pool lane lines to be reeled. As an illustrative embodiment, FIG. 9 shows an apparatus comprising four containing members 212*a*, 212*b*, 212*c*, and 212*d* positioned along an axle 211. As an additional example, an apparatus can comprise a first containing member positioned on a first end of an axle, a second containing member positioned on a second end of the axle, and a third containing member positioned in between the first and second wheel member creating two sections of the axle, each configured to receive one or more lane lines. In some embodiments, an apparatus can comprise a plurality of axles. In some such embodiments, an apparatus comprising two or more sections can contain two or more axles with each axle being capable of rotating independently.

In some embodiments, a containing member can comprise a substantially planar surface. In other embodiments, a containing member can comprise a substantially concave or convex surface. In some embodiments, a containing member can comprise a substantially circular shaped structure. In other embodiments, a containing member can comprise a different shape or configuration. For example in one such embodiment, a containing member can comprise a substantially square-shaped structure. In yet other embodiments, a containing member can comprise any other configuration, for example, a suitable polygon-shaped structure such as a pentagon, hexagon, heptagon, or octagon.

Figure 4:
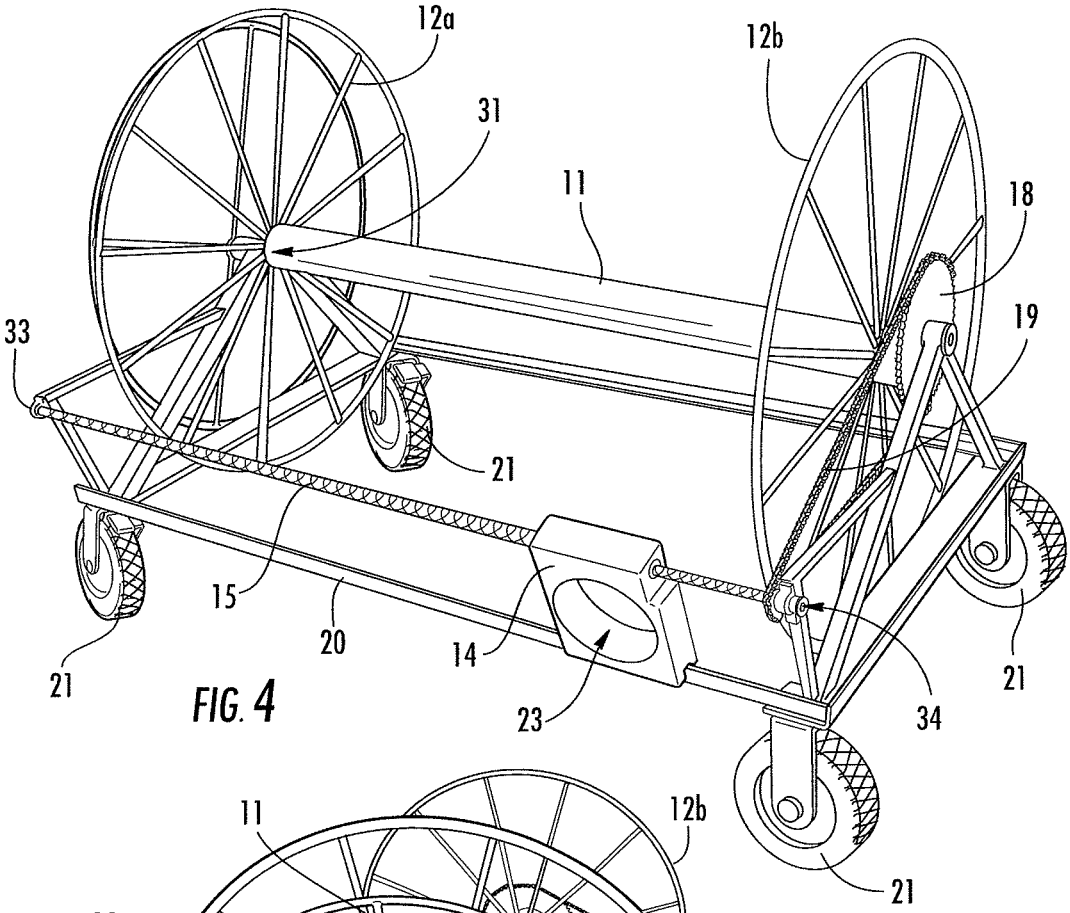
FIG. 4 is a front, top, right side perspective view of an embodiment of an apparatus for reeling pool lane lines.
Figure 5:
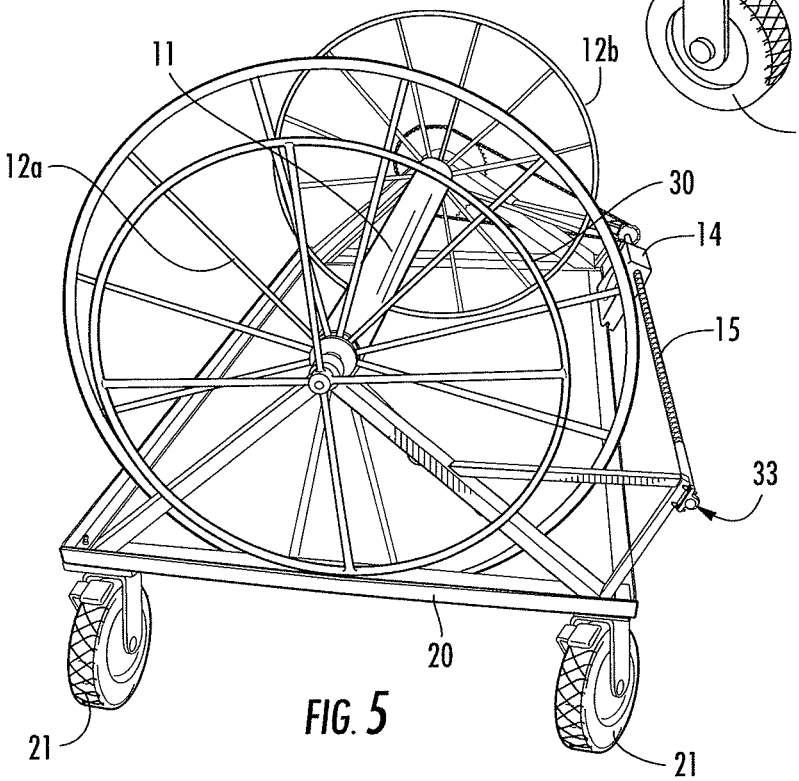
FIG. 5 is a top, left side perspective view showing an embodiment of the apparatus shown in FIG. 4 having a manipulandum comprising a wheel.

In some embodiments, the containing member can comprise a hub, a plurality of spokes, and a rim connecting ends of the spokes. The spokes can extend from a central hub position of the containing member to the rim at the outer perimeter of the containing member. In other embodiments, the containing member can comprise a solid structure, or a structure with one or more cavities provided therein. In some embodiments, the containing member can comprises a hub, spokes, and rim structure in combination with a solid structure. For example, FIG. 1 shows containing members 12*a* and 12*b* having a hub, spokes, and rim structure in combination with a solid ring structure comprising a plurality of openings. In some embodiments, the containing member includes only a hub, spokes, and rim structure. FIGS. 4 and 5 show a pool lane line reeling apparatus comprising containing members 12*a* and 12*b* that do not include a solid structure.

The containing member can be fabricated from a light weight material that provides sufficient strength to withstand the forces during operation of the apparatus. In some embodiments, the containing member can be fabricated from fiberglass, plastic, stainless steel, aluminum, or another suitable material or a combination of materials.

In some embodiments, the apparatus can include a plurality of wheels configured to allow the apparatus to be moved. In some embodiments, one or more of the wheels can swivel. In other embodiments, the orientation of one or more wheels can be fixed with respect to the frame. In some embodiments, an apparatus can comprise a combination of swiveling and stationary wheels. In some embodiments, one or more of the wheels can comprise a brake or a locking mechanism to prevent or slow any unintended movement. In some embodiments, the wheels comprise an all-terrain material such that the wheels can provide a sufficiently stable structure when moving across a wet pool deck, bumps, terrain, landscaping, hoses, drain covers, or other obstructions.

The wheels can comprise, for example, one or more wheels of diameter and material sufficient to roll over a hose. For example, in some embodiments, the wheels can comprise a diameter of greater than about 5 inches. In some embodiments, the wheels can comprise a diameter of at least about six (6) inches, at least about seven (7) inches, at least about eight (8) inches, at least about nine (9) inches, or at least about ten (10) inches. In some embodiments, the wheels can comprise pneumatic rubber tires. In other embodiments, the wheels can comprise solid rubber or plastic tires.

Description of Certain Embodiments with Reference to the Figures

When referring to the Figures, the numbers used within each figure are consistent with every other figure. When a specific feature is labeled in one figure with a specific numeral, the same numeral will be used in other figures when denoting that specific feature.

Referring to the drawings, FIG. 1 shows an embodiment of an apparatus 10 comprising an axle 11, containing members 12*a* and 12*b*, and a lane line guide 14. The apparatus 10 further comprises a frame 20 and a plurality of wheels 21. The axle 11 is positioned between the containing member 12*a* and the containing member 12*b*. In the embodiment shown, the containing member 12*a* is positioned in proximity to a first end 31 of the axle 11. The containing member 12*b* is positioned in proximity to a second end 32 (as shown in FIG. 2) of the axle 11.

In FIG. 1, the lane line guide 14 is positioned about an elongated line guide member 15. The lane line guide 14 comprises a four-sided structure defining a circular path 23. In some embodiments, the lane line guide 14 can be fabricated from plastic, rubber, fiberglass, metal, or another suitable material or a combination of materials. The elongated line guide member 15 can be fabricated from fiberglass, plastic, stainless steel, aluminum, or another suitable material or a combination of materials. The lane line guide 14 is configured to traverse in two directions along the elongated line guide member 15 substantially parallel to the axle 11. FIG. 2 shows the lane line guide in proximity to an end 34 of the elongated line guide member 15. The lane line guide 14 defines a path 23 through which a pool lane line can pass through. As shown in FIG. 1, in some embodiments, the lane line guide 14 can be oriented at an angle less than 90 degrees in relation to a pool deck. In other embodiments, the lane line guide 14 can be oriented perpendicular to a pool deck, or at an angle greater than 90 degrees.

A first gear 17 is positioned in proximity to an end 34 of the elongated line guide member 15. A second gear 18 is in direct communication with the axle 11. The first gear 17 is in communication with the second gear 18 via a chain 19. Upon rotation of the axle 11, the first gear 18 rotates, driving the chain 19, which in turn drives the first gear 17 in the same direction as the second gear 18 and the axle 11. The rotation of the first gear 17 rotates the threaded elongated line guide member 15 to drive the lane line guide 14. The lane line guide 14 is configured to receive the threads of a threaded elongated line guide member 15 and thereby be moved along a longitudinal axis of the elongated line guide member 15. The elongated line guide member 15 comprises a thread configuration such that upon the lane line guide 14 reading the end 33 or the end 34, the lane line guide 14 is automatically redirected in a direction opposite the direction immediately traveled. The thread configuration of the elongated line guide member 15 and the mateable receiving structure of the lane line guide 14 can permit the traversing of the lane line guide member in both directions as the elongated line guide member 15 rotates in a single direction.

Figure 2:
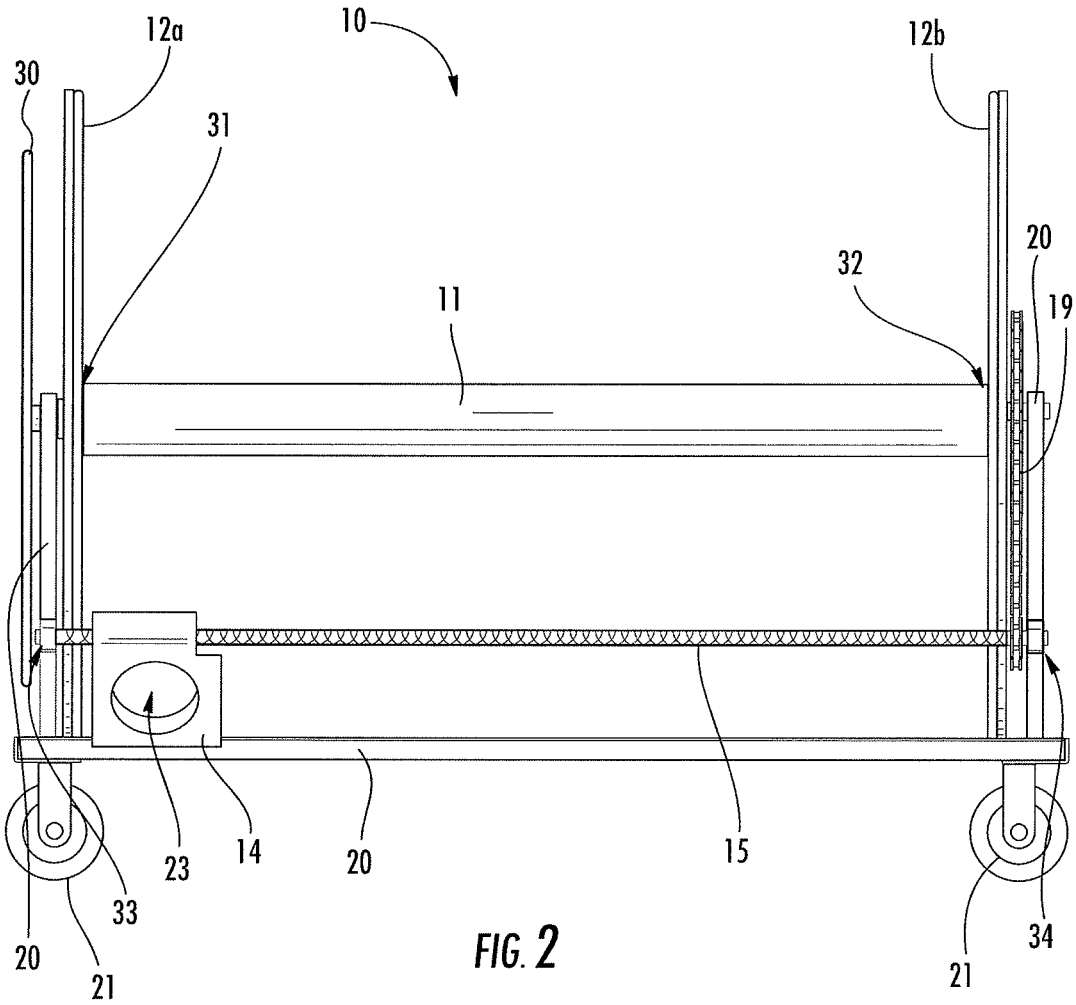
FIG. 2 is a front elevational view showing the apparatus for reeling pool lane lines shown in FIG. 1.
Figure 3:
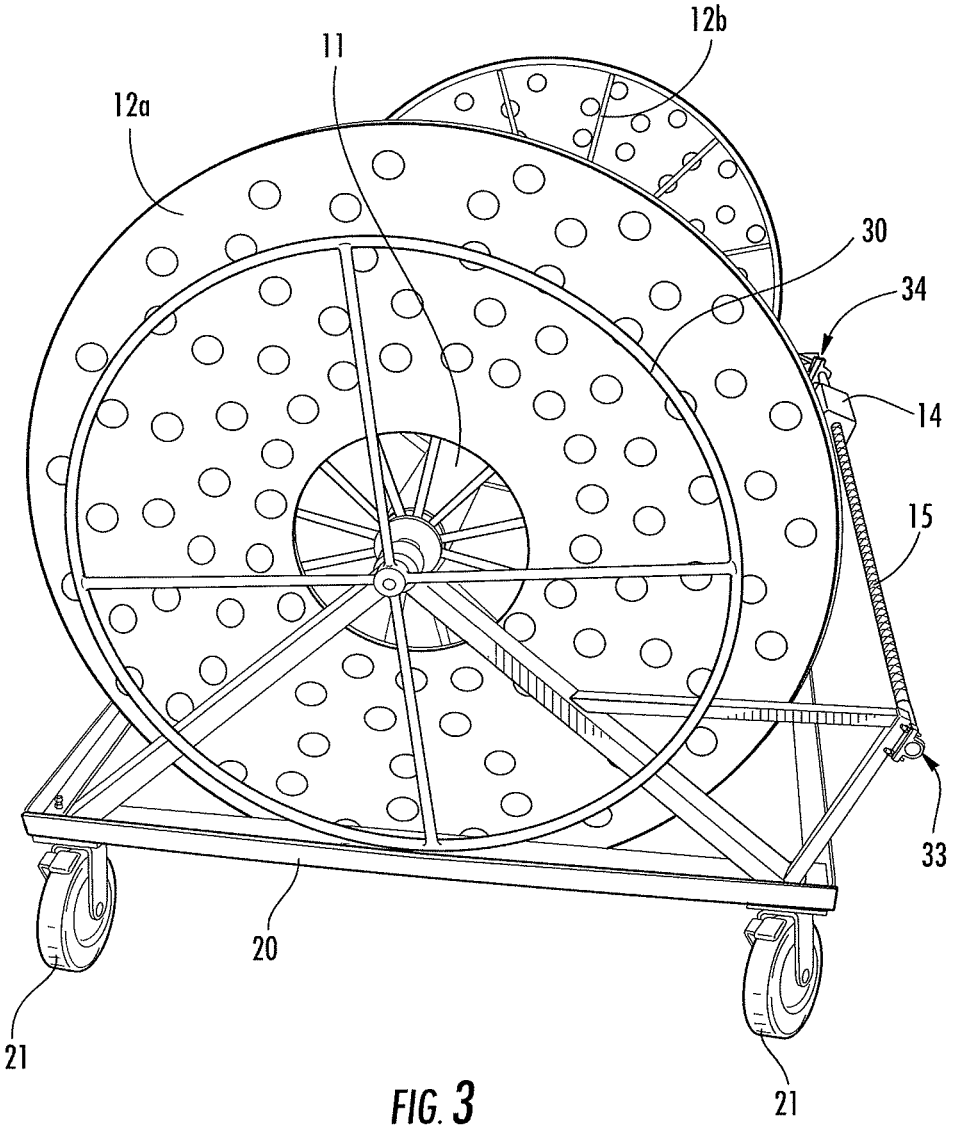
FIG. 3 is a top, left side perspective view showing an embodiment of the apparatus shown in FIG. 1 having a manipulandum comprising a wheel.

FIG. 3 shows a left side view of the embodiment shown in FIG. 1 and 2. In FIG. 3, the manipulandum comprises a wheel 30. As shown in FIG. 3, the wheel 30 is in direct communication with the axle 11, as it is coupled thereto. Upon rotation of the wheel 30, the axle 11 is configured to rotate. As shown in FIG. 3, the wheel 30 can comprise a diameter smaller than the containing member 12*a*. In some other embodiments, the wheel 30 can comprise a substantially smaller or larger diameter than the containing member 12*a*.

Similar to FIGS. 1-3, FIGS. 4 and 5 show an embodiment comprising an axle 11, containing members 12*a* and 12*b*, and a lane line guide 14. The apparatus 10 further comprises a frame 20 and a plurality of wheels 21. The axle 11 is positioned substantially between the containing member 12*a* and the containing member 12*b*. In the embodiment shown in FIG. 4 and 5, the containing member 12*a* is positioned in proximity to a first end 31 of the axle 11. The containing member 12*b* is positioned in proximity to a second end 32 of the axle 11. In FIG. 4, the lane line guide 14 is positioned about an elongated line guide member 15. The lane line guide 14 is configured to traverse along the elongated line guide member 15 substantially parallel to the axle 11.

FIG. 5 shows a left side view of the embodiment shown in FIG. 4. In FIG. 5, the manipulandum comprises a wheel 30. A shown in FIG. 5, the wheel 30 is in direct communication with the axle 11, as it is coupled thereto. In some embodiments, the wheel 30 comprises a diameter smaller than the containing member 12*a*. In some other embodiments, the wheel 30 can comprise a substantially smaller or larger diameter than the containing member 12*a*.

Figure 6:
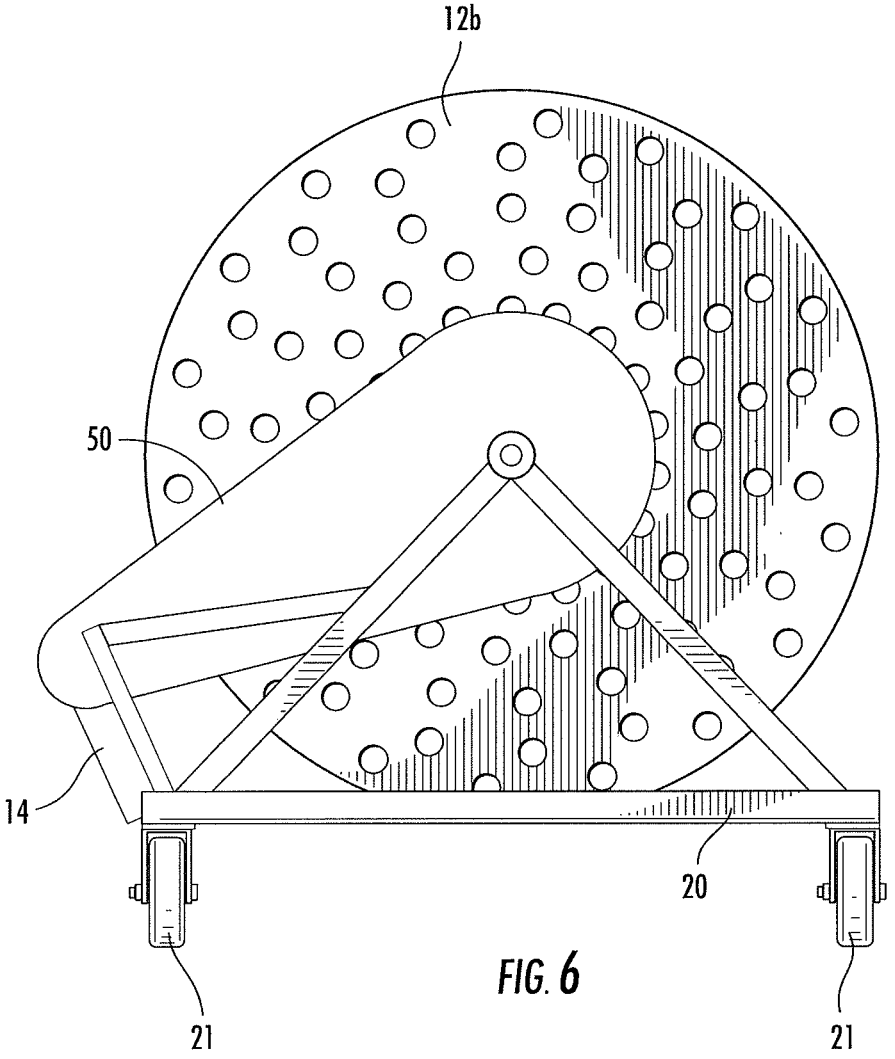
FIG. 6 is a right side elevational view of another embodiment of the apparatus.

FIG. 6 shows a right side view of embodiment similar to those shown in FIGS. 1-5. As shown in FIG. 6, in some embodiments, a guard 50 can be provided to cover at least a portion of the moving parts of a reel apparatus, for example, the chain 19 and gears 17, 18 as shown in FIGS. 1-3. The guards may prevent unintended contact by a user with a moving part.

Figure 7:
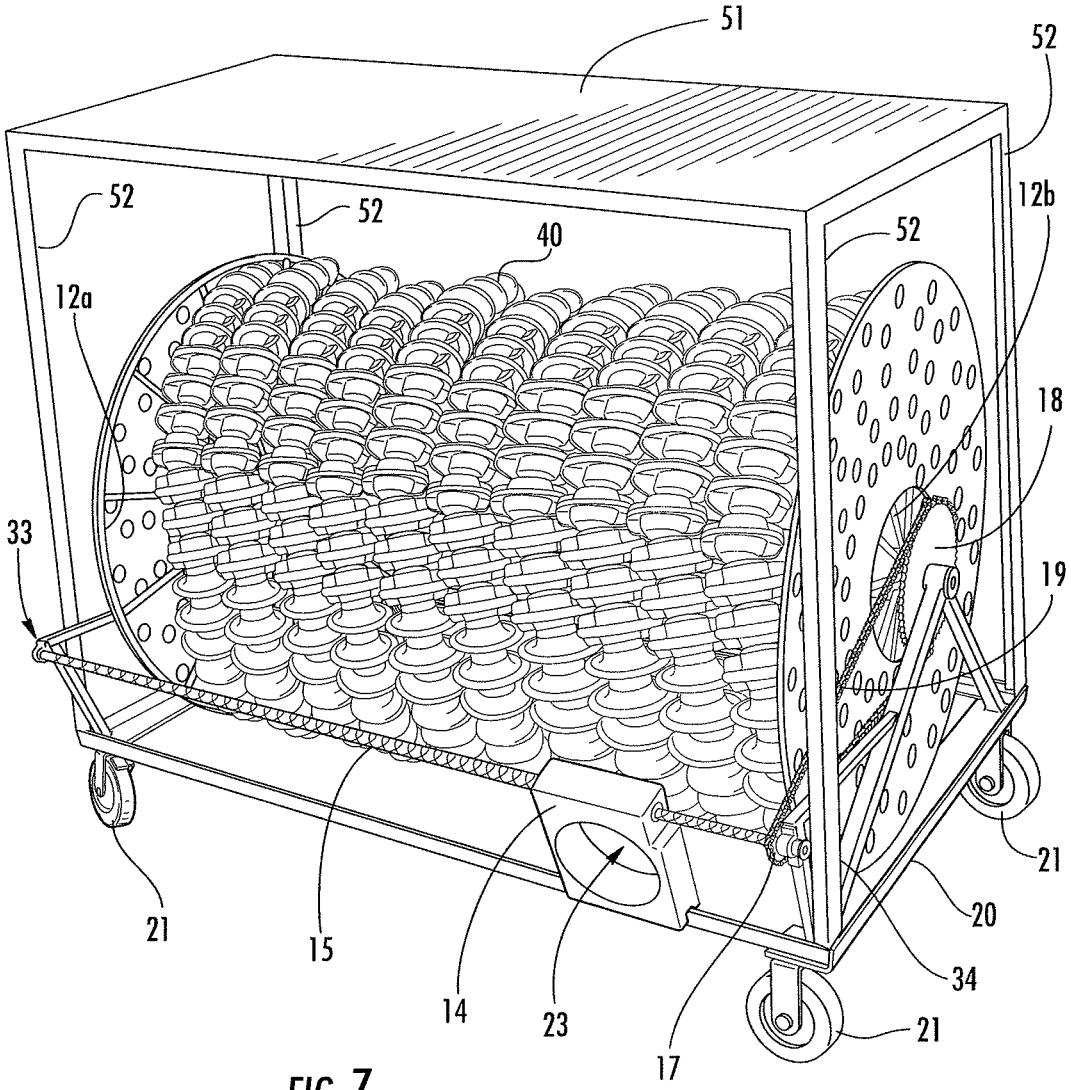
FIG. 7 is a front, top, right side perspective view of another embodiment showing a pool lane line in a reeled position.

FIG. 7 shows an apparatus 10 with a pool lane line 40 stored thereon in a reeled position. In FIG. 7, the frame 20 comprises vertical support members 52 which support a panel 51. In some embodiments, the panel 51 can provide a surface for protection against weather elements or may provide a surface to supports the mounting of solar panels. In some embodiments, the panel 51 can provide a surface to display advertising information, marketing information, sponsorship information, and/or other decorative graphics or materials. In some embodiments, the vertical support member 52 can be permanently affixed to the frame 20. In other embodiments, the vertical support members 52 can temporarily or removably affixed to the frame 20.

FIG. 8 shows an apparatus 10 with a pool lane line 40 in a partially reeled position. The pool lane line extends through the opening of lane line guide 14. In the embodiment shown in FIG. 8, the lane line guide 14 is positioned below a longitudinal axis of the axle 11. For example, a lane line guide 14 may be closer to the ground than the axle 11. In other embodiments (e.g. in FIGS. 12 and 13), the lane line guide may be positioned such that the lane line guide is at a greater or substantially equal distance from the ground as a longitudinal axis of the axle 11.

FIG. 9 shows an apparatus 200 comprising a plurality of sections configured to store a plurality of pool lane lines. The apparatus 200 comprises four containing members 212*a*, 212*b*, 212*c*, and 212*d* positioned along an axle 211. The axle 211 extends the width of the apparatus 200. The apparatus 200 includes two lane line guide members 214*a* and 214*b* each positioned upon a separate elongated line guide member 215*a* and 215*b*, respectively. Similar to the functioning of the apparatus in FIGS. 1-6, a rotating manipulandum (not shown) can be manipulated to rotate the axle 211. The axle 211 can rotate a first gear 218*a* (not shown) and a second gear 218*b*. The elongated line guide members 215*a* and 215*b* are in communication with axle 211 through chains 219*a* and 219*b* and gears 217*a* and 217*b*. In some embodiments, the apparatus 200 may comprise a single elongated line guide member 214 that spans substantially the entire width of the apparatus 200. In some such embodiments, a single set of gears and chain system (217*b*, 218*b*, and 219*b*) can be utilized. As some in FIG. 9, in some embodiments, each section can include a separate lane line guide member 214*a* and 214*b*.

Figure 10:
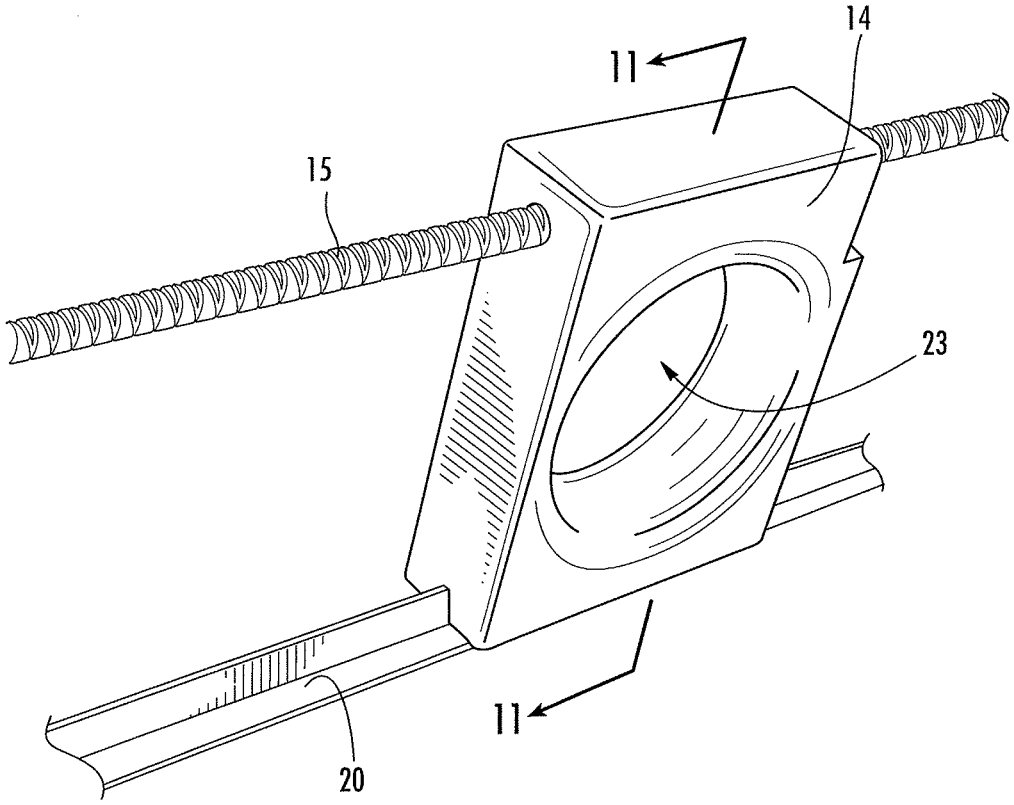
FIG. 10 is a an elevational view of an embodiment showing a lane line guide and an elongated line guide member.
Figure 11:
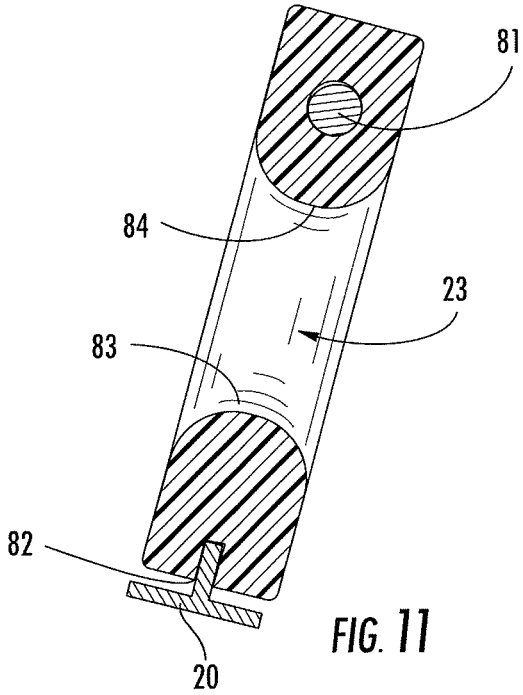
FIG. 11 is a cross sectional view of the lane line guide in FIG. 10 along plane 11-11.

FIGS. 10 and 11 show the lane line guide 14 positioned upon an elongated line guide member 15 and a support member of the frame 20. In the embodiment shown in FIG. 10, the elongated line guide member 15 comprises a threaded shaft. The path 23 comprises a substantially circular shaped opening in the lane line guide 14. FIG. 11 provides a cross sectional view along plane 11-11 shown in FIG. 10, depicting contours 83, 84 of walls of the lane line guide 14 defining the path 23, an opening 81 through which the elongated line guide member 15 extends and which is configured to receive the threads of the elongated line guide member 15, and a slotted track 82 through which a flange of the frame 20 extends. The lower contour 83 and the upper contour 84 are generally a convex shape extending into the opening 23. In some embodiments, the contour as seen in contours 83 and 84 extend around the entire perimeter of the opening 23. In other embodiments, one or both of the contours may be flat.

Figure 12:
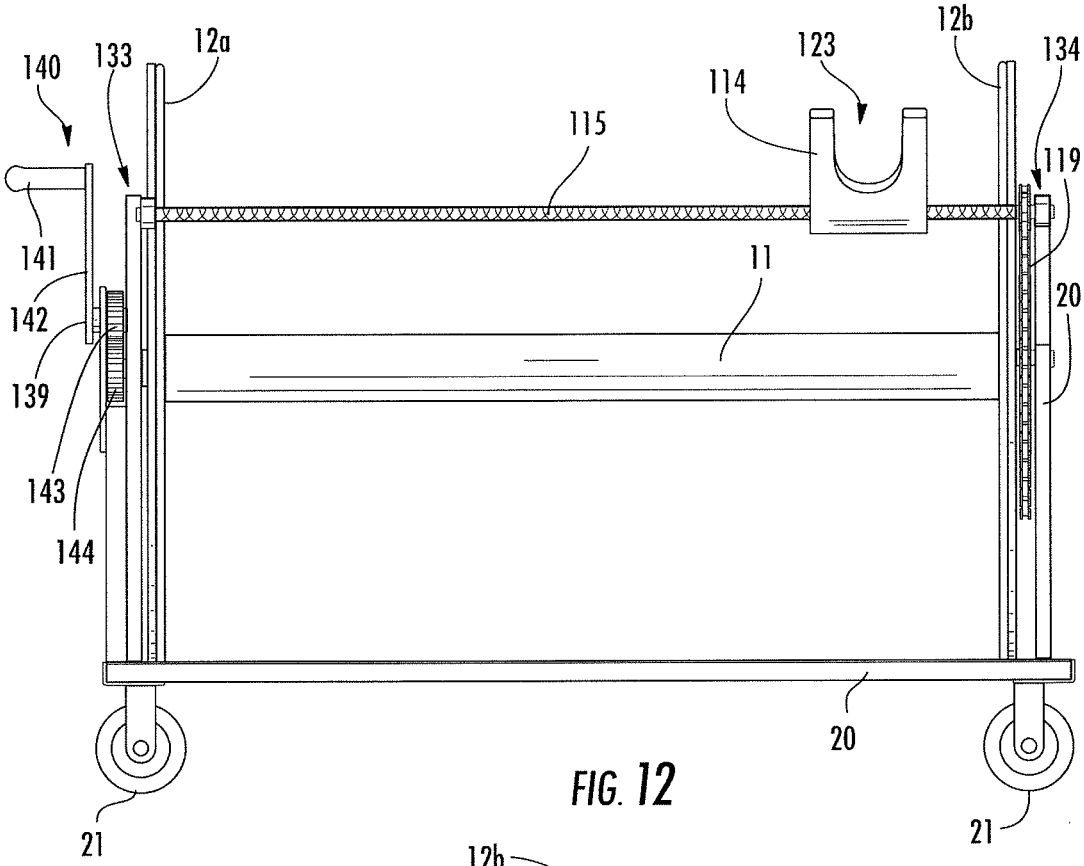
FIG. 12 is a front elevational view showing the apparatus for reeling pool lane lines having manipulandum comprising a crank and a lane line guide comprising a U-shape.
Figure 13:
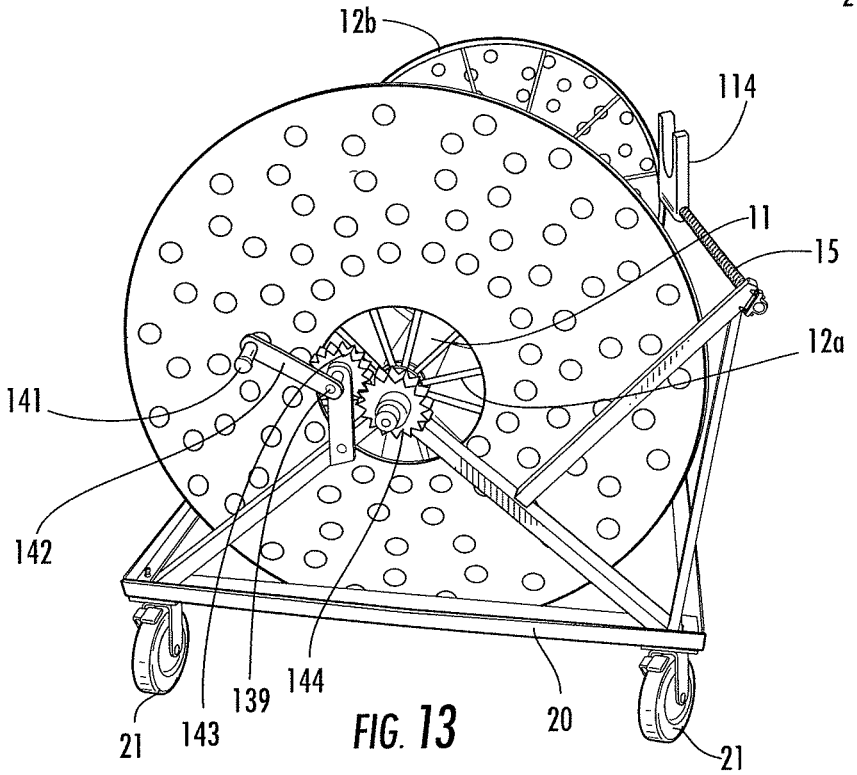
FIG. 13 is a top, left side perspective view showing an embodiment of the apparatus shown in FIG. 12.

In FIGS. 12 and 13, the apparatus can include a manipulandum comprising a crank 140. The crank 140 shown comprises a handle 141, an arm 142, and a hub 139. As shown in FIGS. 12 and 13, the handle 141 extends substantially perpendicular from a containing member 12*a* and substantially parallel to the axle 11. The arm 142 extends substantially parallel from a containing member 12*a* and substantially perpendicular to the axle 11. As shown in FIGS. 12 and 13, in some embodiments, the crank 140 can be rotatably coupled to a portion of the frame 20 and in communication with the axle 11 through one or more gears so that a mechanical advantage can be gained. One or more of the length of the handle 141 and the arm 142, the size and number of gears rotatably coupled thereto can be varied to achieve a desired mechanical advantage.

In FIGS. 12 and 13, the crank 140 is directly be coupled with a first gear 143 which is in rotational communication with a second gear 144. The second gear 144 is coupled to axle 11 as shown. The gears 143 and 144 are configured such that for each full rotation of the crank 140, the axle 11 in communication therewith may rotate less than one full rotation.

In FIG. 12 and 13, the lane line guide 114 is positioned about an elongated line guide member 115. The elongated line guide member 115 is positioned further from the ground than the axle 11. The lane line guide 114 is configured to traverse in two directions along the elongated line guide member 115 substantially parallel to the axle 11. FIG. 12 shows the lane line guide 114 in proximity to an end 134 of the elongated line guide member 115. The lane line guide 114 defines a path 123 through which a pool lane line can extend through. In some embodiments, the lane line guide 114 can be oriented at an angle less than 90 degrees in relation to a pool deck.

A first gear or pulley can be positioned in proximity to either end 133 or 134 of the elongated line guide member 115. A second gear or pulley can be in communication with the axle 11. The first gear or pulley can then be in communication with the second gear or pulley via a chain 119 or a belt. In the embodiment shown in FIGS. 12 and 13, upon rotation of the axle 11, the second gear rotates driving the chain 119 which in turn drives the first gear in the same direction as the second gear and the axle 11. The rotation of the first gear rotates the elongated line guide member 115 to drive the lane line guide 114. In another embodiment, the gears and chain 119 could be located in proximity to the other end 133 of the elongated line guide member 115.

In some embodiments, the lane line guide can be utilized without being in communication with the manipulandum. In some such embodiments, the lane line guide can be positioned about an elongated line guide member comprising a smooth surface, permitting a user to manually position a pool lane line as it is reeled in along an axle without having to touch the lane line itself, thereby helping to avoid pinched fingers or hands. In some embodiments, the lane line guide can be positioned about one or more elongated line guide members. In some embodiments a lane line guide and the elongated line guide member may be a component of a kit. In one such embodiment, the kit can comprise, for example a lane line guide, an elongated member, and a bracket, and can be used to retrofit an existing reel with a lane line guide system. The elongated line guide member can be attached to an existing reel using brackets and techniques known to those of ordinary skill in art, for example, using clamps, screws, bolts, or adhesives. In some embodiments, the kit can comprise one or more elongated line guide members. In some embodiments, the elongated line guide member of the kit can comprise a shape having a generally cylindrical cross-sectional dimension. In other embodiments, the elongated line guide member of the kit can comprise a shape having a generally rectangular or square cross-sectional dimension.

Figure 14A:
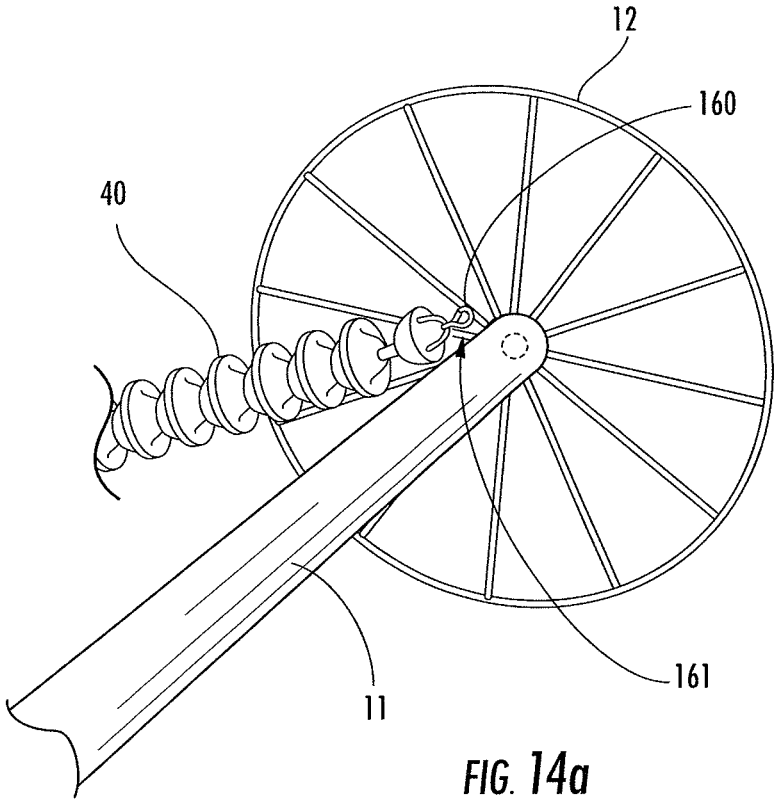
FIG. 14*a* is a view of an embodiment showing the pool lane line attaching to an attachment point.
Figure 14B:
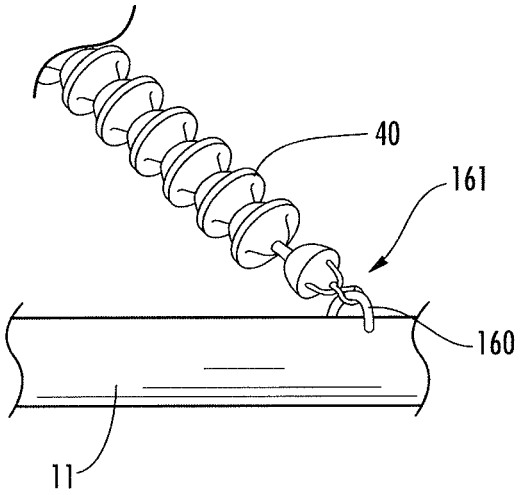
FIG. 14*b* is a view of an embodiment showing the pool lane line attaching to an attachment point.

Upon the rotation of an axle, a pool lane line can be reeled in from a placement in a pool to a stored position wound around the axle, or unwound from a reeled-in, stored position. A pool lane line can comprise two ends. In some embodiments, a first end of a pool lane line can be attached to an attachment point on a reeling apparatus. An attachment point can comprise, for example, a spoke, a clamp, a closed hook, a clasp, a pin, a clip, an eye hook, an opening in a spoke or an axle itself, a retractable chain or cable, a permanently attached chain or cable, or another suitable fastening device. For example as shown in FIG. 14*a*, the attachment point 160 can comprise a marked or unmarked location on a spoke of a containing member. In other embodiments as shown in FIG. 14*b*, the attachment point 160 can be positioned on an axle 11. By attaching the first end 161 of a pool lane line 40 to an attachment point 160, the first end 161 can be secured to provide an anchoring of the pool lane line 40 such that when a reeling device is operated, the pool lane line 40 can wrap around the axle 11 without slipping.

In some embodiments, the apparatus can comprise a plurality of attachment points. The plurality of attachment points can provide anchoring for a plurality of pool lane lines such that a plurality of lane lines can be reeled simultaneously around a single axle. For example, referring to FIG. 9, a first attachment point could be located on a spoke of a containing member 212*b* within the first section and a second attachment point on a spoke of a containing member 212*d* within the second section, so that two lane lines could be reeled in simultaneously. In some embodiments, a second end of a first pool lane line can connect and attach to a first end of a second pool lane line, facilitating the reeling of a plurality of lane lines using only a single attachment point.

In other embodiments, the attachment point can be positioned on or proximate to the exterior of a lane line guide system. In such an embodiment, a user may be able to access the attachment point located in proximity to the exterior of the lane line guide system. In some embodiments, the attachment point can be positioned at the end of a retractable or non-retractable tether, cable, or chain. The other end of the tether, cable, or chain can be fastened to, for example, a spoke of the containing member or an axle. In one such embodiment, the attachment point of a cable or chain can be secured to a portion of a lane line guide when the lane lines are not wound up in the reel apparatus. In such an embodiment, a user may be able to more easily locate and access the attachment point, without having to reach into the interior of a reeling apparatus.

In some embodiments, a pool lane line reeling apparatus can comprise a spring system. A spring can be coupled to the axle to store energy to assist with one or more of a winding or unwinding of a lane line. For example, in one such embodiment, the apparatus comprises a tensioned spring made of steel and configured to store energy as a lane line is unwound from a stored position, and to release at least a portion of the stored energy during the next winding process, lessening the force required to reel in a lane line. In one such embodiment, a locking mechanism can be included to help store energy in the spring. In some such embodiments, a user can use a spring system to adjust the recoil speed of a lane line.

In some embodiments, the pool lane line reeling apparatus can be operated with the aid of a motor. In one such embodiment, the motor can be configured to directly or indirectly manipulate a manipulandum, such as a gear or pulley-shaped manipulandum. Upon manipulation of the manipulandum by action of the motor, the axle can be rotated. In some such embodiments, the motor can be configured to operate in both a forward and reverse direction such that the apparatus may be used to automatically reel the lane lines into a reeled position or aid in the unwinding of the lane lines for use in the pool. In such embodiments, inclusion of a motor can serve to reduce the number of users needed to wind or unwind a lane line, and can decrease the amount of time required to wind or unwind a lane line.

Figure 15:
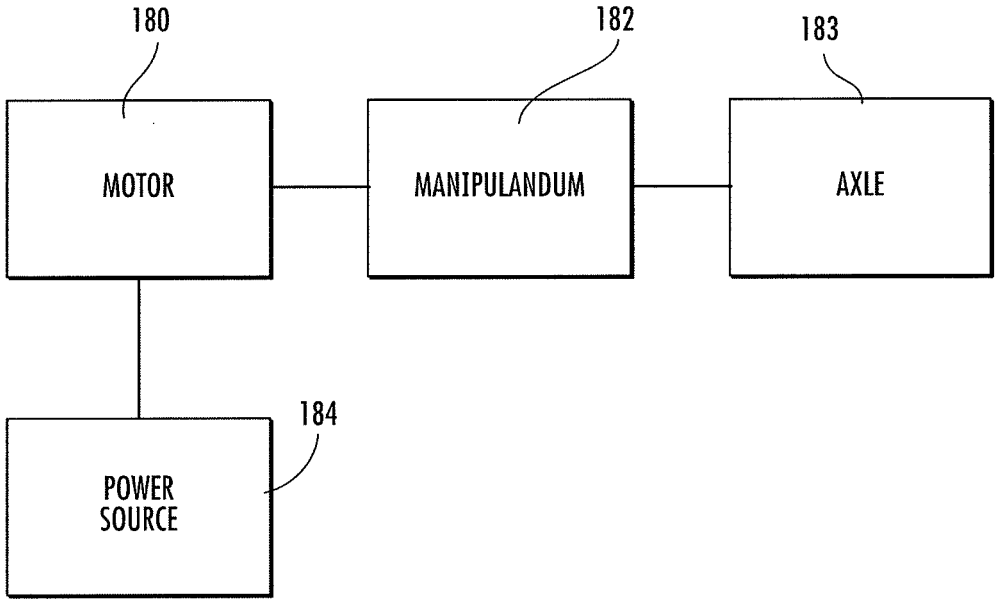
FIG. 15 is schematic comprising a block diagram showing an embodiment of an apparatus for reeling pool lane lines having a motor.

In some embodiments, the motor can be enclosed, for example with a case made from a waterproof material. In some embodiments, an enclosure for a motor can comprise a waterproof sealant to minimize any mechanical or electrical components exposure to water. Referring to an embodiment shown in FIG. 15, the motor 180 can be operably connected to the manipulandum 182 which is in communication with the axle 183. In some embodiments, the manipulandum 182 can be a gear. The motor 180 can be powered by the power source 181.

Figure 16:
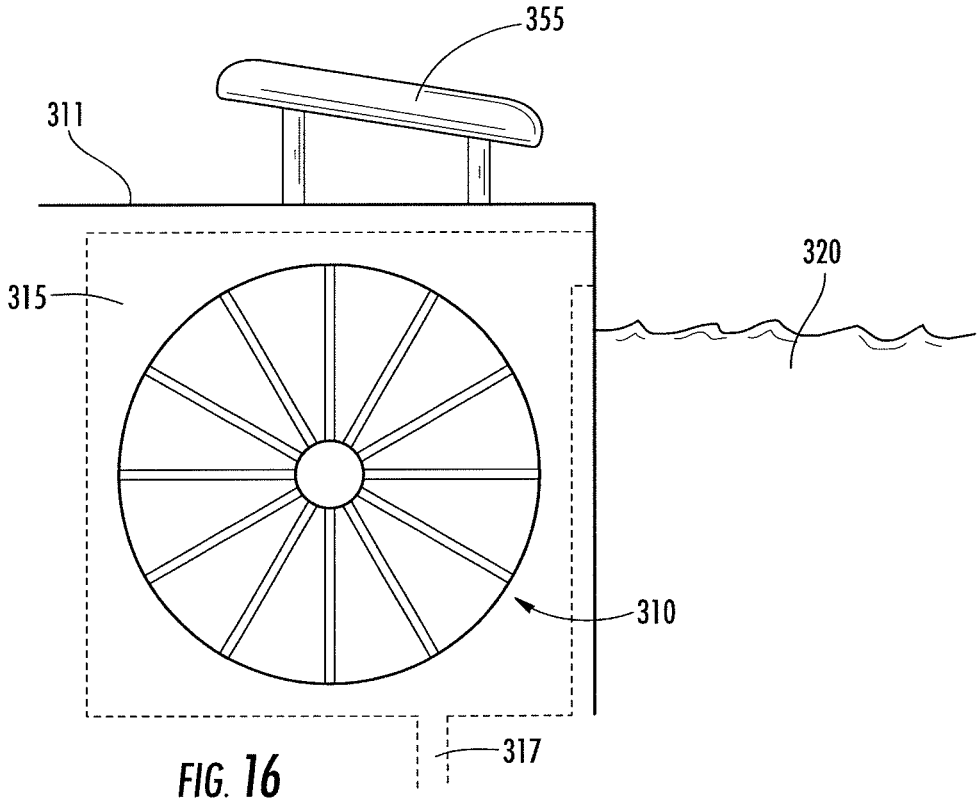
FIG. 16 is a side view of a pool lane line reeling apparatus positioned in a reel well.

In some embodiments, a pool lane line reel apparatus can be permanently or temporarily positioned in proximity to a pool wall. For example as seen in FIG. 16, a pool lane line reeling apparatus 310 can be positioned below a pool deck level 311 in a reel well 315. In some embodiments, as shown in FIG. 16, the pool lane line reeling apparatus 310 can be oriented in a generally vertical orientation. In other embodiments, the pool lane line reeling apparatus 310 can be oriented in a generally horizontal orientation, similar to the orientation found in FIG. 18, with the pool lane line reeling apparatus positioned below the pool deck 311. In some embodiments, a reel well 315 comprising a lane line storage apparatus 310 can comprise a motor. In some such embodiments, the motor can provide a motorized method of reeling and unwinding of pool lane lines. In some such embodiments, the pool lane lines can retract to a position substantially or wholly behind the plane of the wall of the pool or bulkhead. A reel well 315 can comprise an access point where a user can access the reel, a containing member, a motor, a manipulandum, or any other component needed to perform any maintenance or installation. In some embodiments, the reel well can have an outlet point 317, such as a drain, for any water that accumulates within the reel well. In some such embodiments, the outlet point 317 can comprise a pump to pump any collected water back into the main body of the pool.

In some embodiments, a removable manipulandum can be used to reel the pool lane line reeling apparatus 310. In some embodiments, the removable manipulandum can be positioned above the pool deck 311 and can be in communication with an axle positioned below the pool deck 311. For example, in some embodiments, the removable manipulandum can comprise a crank. In some such embodiments, the crank having a male end can be positioned in a mateable female end of a gear or other component. The gear or other component can be in communication with the axle of pool lane line reeling apparatus 310. Upon manipulation of the crank, the axle can be rotated. In some embodiments, the mateable female end can be positioned such that it does not project above the surface of the pool deck 311. In some embodiments, the mateable female end can be positioned beneath a flap or door. The flap or door can be opened and closed to provide access to the mateable female end.

Figure 17:
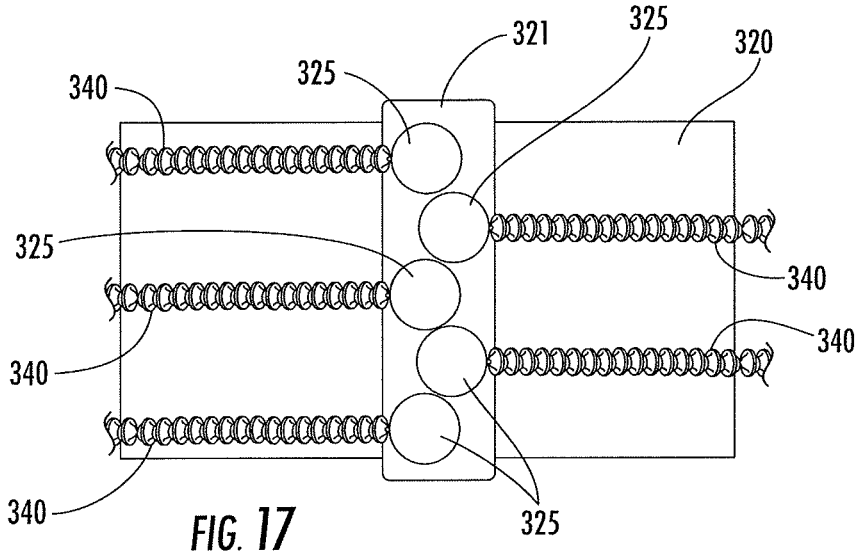
FIG. 17 is a top elevational view of pool bulkhead structure comprising pool lane line reeling apparatuses.

In other embodiments, the pool lane line reeling apparatus can be positioned in a reel well within a moveable pool bulkhead structure. FIG. 17 shows a top elevational view of a pool 320 comprising a moveable pool bulkhead structure 321 that can be used to create lanes or varying lengths within the pool 320. One or more reels 325 storing pool lane lines 340 can be mounted within the pool bulkhead structure 321. A reel 325 can be configured to take up or provide slack to a lane line 340 while the bulkhead 321 is moved.

In some embodiments, a pool can comprise a plurality of reel wells that correlate to the number of pool lanes. Each reel well can be configured to store one or more pool lane lines. The dimensions of a reel well can correspond to the dimensions of an apparatus used to store one or more pool lane lines. The depth and width of the reel well can vary, for example, in an inverse relationship, where as the depth of the reel well increases, the required width can decrease.

Figure 18:
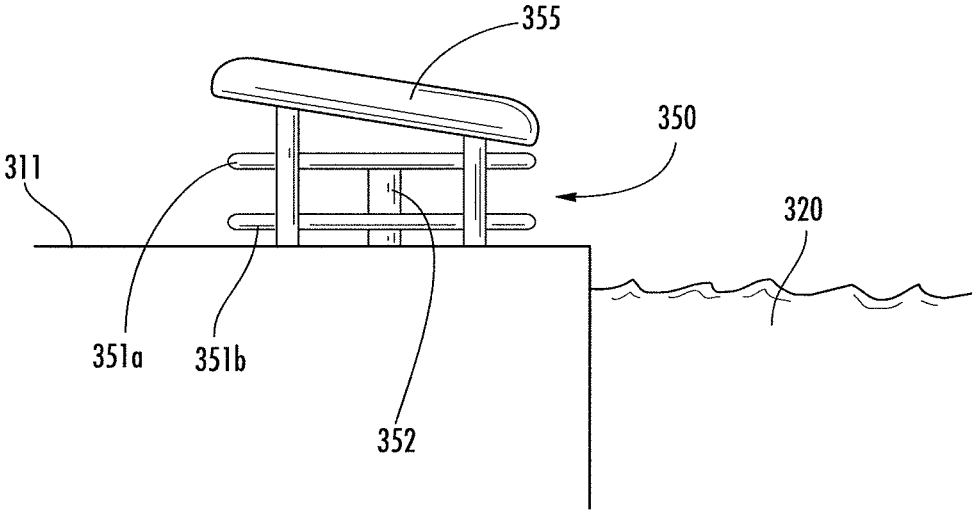
FIG. 18 is a side view of an embodiment having a pool lane line reeling apparatus positioned under a starting block.

In some embodiments, a pool lane line reeling apparatus can be permanently or temporarily positioned on or about a pool deck surface, for example under a starting block. A pool lane line reeling apparatus can be oriented horizontally or vertically such that the apparatus does not materially impact the height of a standard starting block. In one such embodiment, one or more pool lane lines can be reeled around a central vertical axle under the starting block for each lane. As shown in FIG. 18, a starting block 355 can be positioned on a pool deck 311. A reeling apparatus 350 can be positioned under the starting block 355 with an axle 352 oriented in a substantially vertical direction. The axle 352 can be in communication with containing members 351*a* and 351*b*. A pool lane line can be reeled in, stored, and unwound about the axle 352.

Some embodiments of a pool lane line reel apparatus can reduce the number of users needed and/or the amount of time needed to reel in and unwind a lane line. Some embodiments of a pool lane line reel apparatus can eliminate the need of multiple users to operate the reel apparatus. A reduction in number of users can result in a savings of time or labor costs associated with operating a pool lane line reel apparatus. For example, instead of paying for the time required for two to four users to operate a reel apparatus, some embodiments can allow a single user to operate a reel apparatus to perform a reeling or unreeling function. In some embodiments, the stress applied to specific components of the reel apparatus may be reduced, thus preserving the useful life of the reel apparatus.

Although the present invention has been described with reference to particular embodiments, it should be recognized that these embodiments are merely illustrative of the principles of the present invention. Those of ordinary skill in the art will appreciate that an apparatus and system for reeling and storing swimming pool lane lines may be constructed and implemented in other ways and embodiments. Accordingly, the description herein should not be read as limiting the present invention, as other embodiments fall within the scope of the present invention. Numerous modifications and adaptations thereof will be readily apparent to those skilled in the art without departing from the spirit and scope of the present invention.

What is claimed is:

1. A pool lane line reeling apparatus for use on a pool deck surface comprising:

a frame;

an axle that receives a pool lane line therearound, wherein the axle is rotatably coupled to the frame;

a manipulandum in communication with the axle, wherein the axle rotates when the manipulandum is manipulated;

a lane line guide movably coupled to the frame, wherein the lane line guide comprises an axis and defines a path substantially perpendicular to the axis of the lane line guide to allow passage of the pool lane line onto the axle; and an elongated line guide member wherein the lane line guide traverses along the elongated line guide member, wherein the angle between the pool deck surface and the axis of the lane line guide is less than 90 degrees.

2. The apparatus of claim 1, further comprising a containing member positioned with relation to the axle such that the containing member defines a boundary for the pool lane line along the axle.

3. The apparatus of claim 2, wherein the containing member rotates with the axle when the manipulandum is manipulated.

4. The apparatus of claim 2, wherein the containing member comprises a first containing member positioned in proximity to a first end of the axle and defining a first boundary, and further comprising a second containing member positioned in proximity to a second end of the axle to define a second boundary for the pool lane line along the axle.

5. The apparatus of claim 1, wherein the elongated line guide member comprises a threaded shaft rotatably coupled to the frame to drive the lane line guide in two substantially opposite directions along an axis of the elongated line guide member.

6. The apparatus of claim 1, wherein the elongated line guide member is in communication with the manipulandum and wherein the elongated line guide member moves the lane line guide when the manipulandum is manipulated.

7. The apparatus of claim 1, wherein the lane line guide is positioned below a central longitudinal axis of the axle.

8. The apparatus of claim 1, wherein at least a portion of the frame is permanently affixed in proximity to a pool.

9. The apparatus of claim 1, further comprising a plurality of wheels coupled to the frame and configured to allow the apparatus to be wheeled around.

10. A pool lane line reeling apparatus comprising:

a frame;

an axle configured to receive a pool lane line therearound, wherein the axle is rotatably coupled to the frame;

a containing member positioned with relation to the axle such that the containing member defines a boundary for the pool lane line along the axle;

a manipulandum rotatably coupled to the frame in communication with the axle, wherein the axle is configured to rotate by less than one full rotation upon the rotation of the manipulandum by one full rotation and wherein the containing member rotates with the axle when the manipulandum is manipulated; and an electric motor configured to manipulate the manipulandum.

11. A pool lane line reeling kit to be mounted on a pool lane line reeling apparatus comprising:

an elongated line guide member comprising a threaded shaft;

a lane line guide configured to be moved along the elongated line guide member upon rotation of the elongated line guide member; and a bracket configured to mount the elongated line guide member to a pool lane line reeling apparatus, wherein the lane line guide is oriented at an angle facing downward upon mounting to the pool lane line reeling apparatus.

* * * * *